US005689970A

United States Patent [19]

Chopas

[11] Patent Number: 5,689,970

[45] Date of Patent: Nov. 25, 1997

[54] ENZYME COOLER WITH POROUS FOAM REFRIGERANT BLOCK

[75] Inventor: Nicholas J. Chopas, Germantown, Md.

[73] Assignee: Life Technologies, Inc., Gaithersburg, Md.

[21] Appl. No.: 597,799

[22] Filed: Feb. 7, 1996

[51] Int. Cl.[6] ..... F25D 3/08

[52] U.S. Cl. ..... 62/372; 62/457.2; 62/457.5

[58] Field of Search ..... 62/530, 371, 372, 62/457.1, 457.2, 457.5, 457.4, 529

[56] References Cited

U.S. PATENT DOCUMENTS

| | | | |
|---|---|---|---|
| 2,393,245 | 1/1946 | Hadsell | 62/1 |
| 3,309,893 | 3/1967 | Heffler et al. | 62/372 |
| 3,338,068 | 8/1967 | Piker | 62/398 |
| 3,922,879 | 12/1975 | Arnold | 62/458 |
| 3,940,249 | 2/1976 | McClurg | 23/230 |
| 4,145,895 | 3/1979 | Hjertstrand et al. | 62/529 |
| 4,292,817 | 10/1981 | Loucke | 62/457 |
| 4,322,954 | 4/1982 | Sheehan et al. | 62/371 |
| 4,377,077 | 3/1983 | Granlund | 62/457 |
| 4,425,998 | 1/1984 | Hof et al. | 206/306 |
| 4,498,312 | 2/1985 | Schlosser | 62/457 |
| 4,530,816 | 7/1985 | Douglas-Hamilton | 62/372 |
| 4,850,484 | 7/1989 | Denman | 206/366 |
| 5,024,067 | 6/1991 | Maier, II | 62/457.4 |
| 5,181,394 | 1/1993 | Schea, III et al. | 62/371 |
| 5,215,208 | 6/1993 | Jackson | 220/516 |
| 5,405,012 | 4/1995 | Shindler et al. | 206/569 |
| 5,417,082 | 5/1995 | Foster et al. | 62/457.1 |
| 5,435,142 | 7/1995 | Silber | 62/372 |

*Primary Examiner*—John M. Sollecito

*Attorney, Agent, or Firm*—Sterne, Kessler, Goldstein & Fox PLLC

[57] ABSTRACT

A cooler assembly for maintaining vials filled with enzyme samples in a chilled state. The cooler assembly includes a foam block having wells disposed therein for holding vials of samples in an upright position. The cooler assembly also includes an outer foam box and a lid. The foam block is positioned inside the outer foam box. The lid is then positioned on top of the outer foam box to provide further insulation for the foam block. In use, the foam block is filled with a liquid, such as water, via a fill hole. The foam block is then frozen. Vials are placed in the wells of the frozen foam block so that the contents of the vials remain cool when placed in a room having an ambient temperature. The inner foam block is made from self-skinning, open cell foam. The skin on the foam block renders the block leak-proof. The cooler assembly provides for efficient heat transfer between the chilled wells of the foam block and the contents of the vials.

27 Claims, 10 Drawing Sheets

ENZYME COOLER WITH POROUS FOAM REFRIGERANT BLOCK

BACKGROUND OF THE INVENTION

1. Field of the Invention

The present invention relates to an apparatus for maintaining vials containing laboratory samples in a chilled or warmed state. Specifically, the present invention is an enzyme cooler to keep enzyme samples cool in a laboratory environment.

2. Related Art

Enzymes must be kept in a chilled state so that the enzymes remain active for laboratory experiments. If an enzyme is allowed to reach an ambient temperature, the samples may become inactive, thereby mining the experiment. Thus, it is important to keep enzyme samples as cool as possible at all times during testing or experimentation. When not in use, enzymes are generally stored in vials, also referred to as Ependorf tubes. These vials are stored in a refrigerator or other cooling device so that the samples contained therein remain cool, and thus active. During experimentation, several vials containing samples may be needed. Rather than continuously opening and closing a refrigerator or other cooling device to gain access to the needed samples, a means for keeping the vials cool while they are outside of refrigeration is needed.

Several different cooling devices have been constructed to address the problem of keeping samples cool. One such device is a cooler having a hard plastic outer shell. The shell forms a rectangular cooler having wells on one side to hold the vials in an upright position. The wells in the shell are positioned in rows across the top of the shell. The shell is filled with a gel containing foam beads. The cooler is placed in a freezer and the gel is allowed to freeze. The foam beads allow for expansion of the gel when it freezes so that the plastic shell does not crack.

To use this cooler, the user places the shell in the freezer until the gel is completely frozen. Then, the wells are filled with the enzyme vials and can be taken out of the freezer and placed on a lab bench or other work surface. Often, the cooler is accompanied by a chart that tells the user, usually graphically, the temperature change of the cooler versus the time that the cooler has been out of the freezer. Thus, the user relies on this chart to determine how long the enzyme vials can be out of refrigeration before degradation of the samples begins to occur. Once the time limit is reached, the vials must be put back in refrigeration.

This type of conventional cooler construction has several drawbacks. For example, when the hard plastic shell is removed from the freezer, a condensation forms on the outside of the shell. This condensation makes the shell slippery. Thus, the user is likely to drop the cooler. When frozen, dropping the cooler will result in shattering of the cooler shell due to changes in the properties of the plastic material under low temperatures. These units are expensive to replace, and thus breakage of an enzyme cooler should be avoided.

Another drawback with a gel-filled, plastic cooler is that the vials often fit loosely into the hard plastic wells. Thus, air and a layer of hard plastic form barriers between the vial and the cooled gel and prevent efficient heat transfer between the enzymes and the gel. Another cause for inefficient heat transfer is due to the use of adapters. Because vials may come in more than one size, some coolers have adapters.

These adapters are designed to fit in the wells and resize the well to accommodate smaller vials. Although these adapters provide a better fit for the smaller vials, they also create an extra barrier between the vial and the frozen gel which results in further inefficiencies in heat transfer.

Another drawback with a gel-filled, plastic cooler is that the outer wells of the cooler tend to warm up faster than the center wells. The charts that accompany the cooler give the user only an overall change in temperature of all the wells over time. Thus, if the user relies on the chart, the samples may be kept out of refrigeration for too long, and those samples in some of the outer wells may reach a critical temperature and become mined, unbeknownst to the user.

A further drawback of a gel-filled, plastic cooler is that once the gel thaws, the temperature of the wells and thus the temperature of the samples in the vials rises rapidly. At the point of thawing of the gel, the samples can reach a critical temperature very quickly. If the user steps away from the laboratory or is in the middle of an experiment and does not notice that the recommended time for non-refrigeration has elapsed, the samples could easily become ruined.

Thus, an enzyme cooler is needed that provides for a maximum heat transfer between the wells in the cooler and the vials and that provides an even temperature distribution across all of the wells in the cooler. Further, an enzyme cooler is needed that does not rapidly increase in temperature as it undergoes a phase change.

SUMMARY OF THE INVENTION

The present invention relates to an enzyme cooler that provides for efficient heat transfer between a cooling medium and laboratory samples in vials. Further, the present invention provides for a relatively even temperature distribution across all the wells in the cooler. Samples are maintained below a critical temperature for a relatively long period of time, thereby preventing accidental degradation of the samples due to sudden exposure to above critical temperatures.

The cooler assembly of the present invention includes a foam block made from self-skinning, open cell foam. The skin of the foam block renders it substantially leakproof. The foam block has wells disposed therein for holding vials filled with samples. The vials are held in an upright position. The wells are also sealed to render them leakproof. The foam block further contains one or more fill holes to allow the foam block to be filled with a liquid for freezing. The foam block can be placed within an outer foam box, also made from open cell foam or closed cell foam. The outer foam box provides insulation, so that the liquid inside the foam block remains cooler for a longer period of time. A lid may also be placed on top of the outer foam box to trap the insulated cool air inside the assembly.

To use the assembly, the inner foam block is filled with a liquid via one or more fill holes in the foam block. The fill holes are then capped, and the assembly is placed in a freezer until the liquid inside the foam block freezes. Vials of samples are then placed in the wells of the frozen foam block.

Once frozen, the cooler assembly can be removed from the freezer and placed in a room at an ambient temperature for easy access to the samples during experimentation. The cooler assembly includes a temperature chart or graph. This graph shows the user the approximate amount of time that the cooler can remain outside the freezer before a particular sample approaches its critical temperature. Additionally, a temperature indicator may be placed on the foam block or in a sample well to visually indicate to the user the temperature of the block.

Because the wells are made from foam, the vials fit snugly therein, to provide efficient heat transfer between the foam block and the vials. Further, the temperature of the liquid inside the foam block does not rise as rapidly as in the gel-filled mold. As such, the temperature of the wells in the present invention reach a critical temperature at a more gradual pace than in a conventional enzyme cooler. Thus, the likelihood of accidental damage to the samples is minimized. Finally, the open cell foam of the foam block allows the liquid to surround all of the wells in the foam block equally. This feature, combined with the added insulative properties of the outer foam box, provides equal temperature distribution across all the wells in the cooler.

BRIEF DESCRIPTION OF THE FIGURES

The foregoing and other features and advantages of the invention will be apparent from the following, more particular description of a preferred embodiment of the invention, as illustrated in the accompanying drawings.

DETAILED DESCRIPTION OF THE PREFERRED EMBODIMENT

A preferred embodiment of the present invention is now described with reference to the figures where like reference numbers indicate identical or functionally similar elements. Also in the figures, the left most digit of each reference number corresponds to the figure in which the reference number is first used. While specific configurations and arrangements are discussed, it should be understood that this is done for illustrative purposes only. A person skilled in the relevant art will recognize that other configurations and arrangements can be used without departing from the spirit and scope of the invention. It will be apparent to a person skilled in the relevant an that this invention can also be employed in a variety of other devices and applications.

Figure 1:
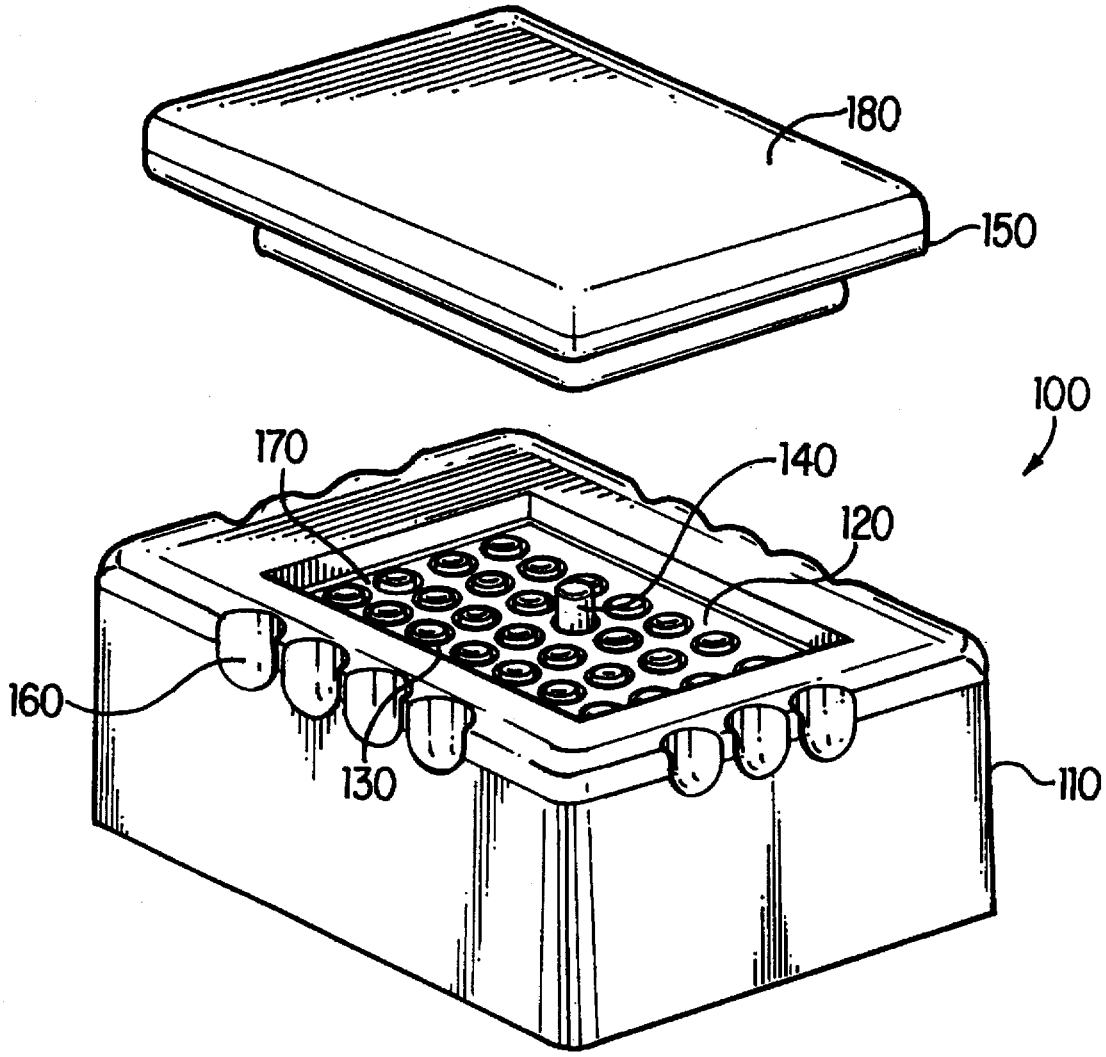
FIG. 1 shows a perspective view of an enzyme cooler assembly of the present invention having a raised lid.

FIG. 1 shows a perspective view of an enzyme cooler assembly 100 of the present invention. Enzyme cooler assembly 100 includes an outer foam box 110, a foam block 120 and a lid 150. Foam block 120 has several wells 130 formed in a side 170 of foam block 120. Wells 130 are configured to hold vials 140. Vials 140 may be full of enzyme samples or other laboratory samples. Outer foam box 110 is made from an open cell foam and is not filled with a liquid or a gel. Thus, condensation should not form on the surface of outer foam box 110, and it should not become slippery when removed from a freezer. Further, even if outer foam box 110 were dropped after being removed from the freezer, it would not shatter like the plastic used in conventional enzyme coolers.

Outer foam box 110 has indentations 160 on an area 540 (shown in FIG. 5) between an outer perimeter 520 and an inner perimeter 530 of outer foam box 110. Indentations 160 facilitate lifting off lid 150. Lid 150 may be made from an open cell foam. Alternatively, lid 150 can be made from a clear plastic so that the user can see inside the cooler while lid 150 remains on top of outer foam box 110. Lid 150 may also have a grid (not shown) printed on its outer surface 180. This grid uses a numbering system of rows and columns to positively identify the vials in each well.

Figure 2:
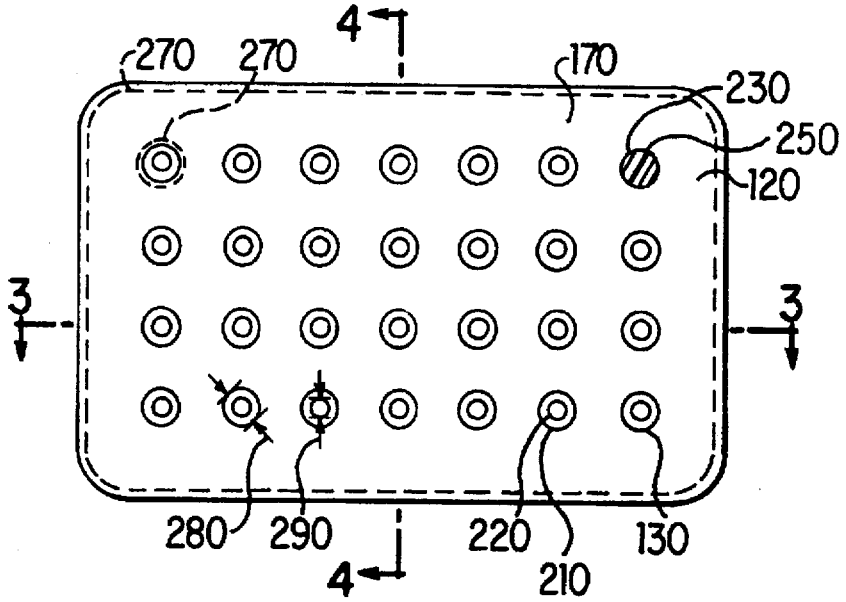
FIG. 2 shows a top view of a foam block of the enzyme cooler assembly of FIG. 1.
Figure 3:
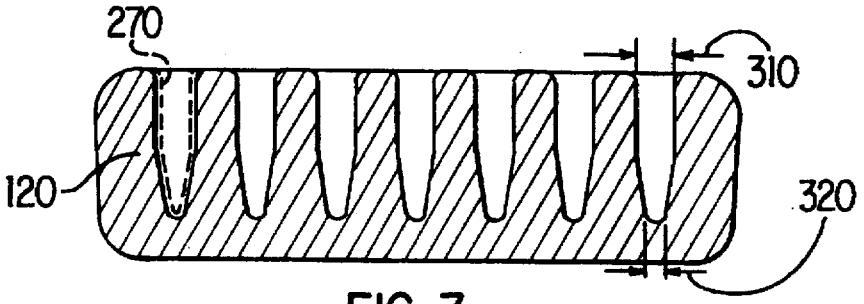
FIG. 3 shows a sectional side view of the foam block of FIG. 2 taken along line 3—3.
Figure 4:
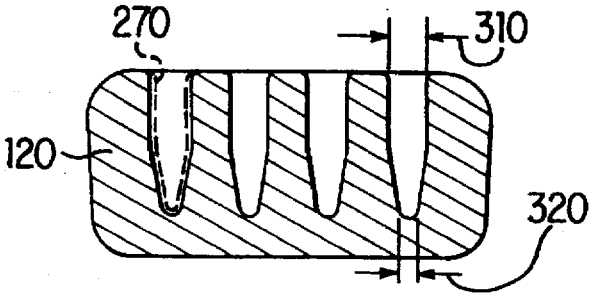
FIG. 4 shows a sectional side view of the foam block of FIG. 2 taken along line 4—4.

Referring now to FIGS. 2–4, foam block 120 may be made from a self-skinning, open cell foam, such as urethane. The foam is poured into a mold, and an outer layer or skin 270 forms. Alternatively, foam block 120 could be made from open cell foam and then sealed with a sealant to render it leakproof. Wells 130 are similarly sealed with a leakproof skin 270. However, fill hole 230 is left unsealed so that foam block 120 may be filled with a coolant. The use of the open cell foam allows the coolant to be "absorbed" by foam block 120. Thus, foam block 120 provides for better distribution of the coolant to each well 130 and thus more efficient heat transfer to the samples in each vial 140 than a conventional enzyme cooler.

In the preferred embodiment, foam block 120 is filled by the following method. First, foam block 120 is weighed on a scale and the weight is recorded. Then, foam block 120 is submersed in water and allowed to fill. As the foam block continues to fill, the user squeezes foam block 120 to remove trapped air from the foam cells. The user then slowly releases foam block 120 to allow the water, and not air, to be drawn back into foam block 120. Foam block 120 is then placed back on the scale, and the weight is again recorded. Foam block 120 is full if the weight change is within the range of 275–300 grams. To seal foam block 120, the user pushes a plug 250 into fill hole 230. In an alternate embodiment, foam block 120 may be filled with a brine or salt solution, a gel made from starch, or glycerine.

The configuration and shape of wells 130 and fill hole 230 is shown in FIGS. 2–4. An outer well perimeter 210 is shown in FIG. 2. Outer well perimeter 210 represents the perimeter of wells 130 at a point 310 where each well is flush with the top of foam block 120. In the preferred embodiment, the diameter 280 of outer well perimeter 210 is approximately 0.4 inches. FIG. 2 also shows an inner well perimeter 220. Inner well perimeter 220 represents the perimeter of wells 130 at a point 320 at the bottom of each well. In the preferred embodiment, the diameter 290 of inner well perimeter 220 is approximately 0.2 inches.

Figure 5:
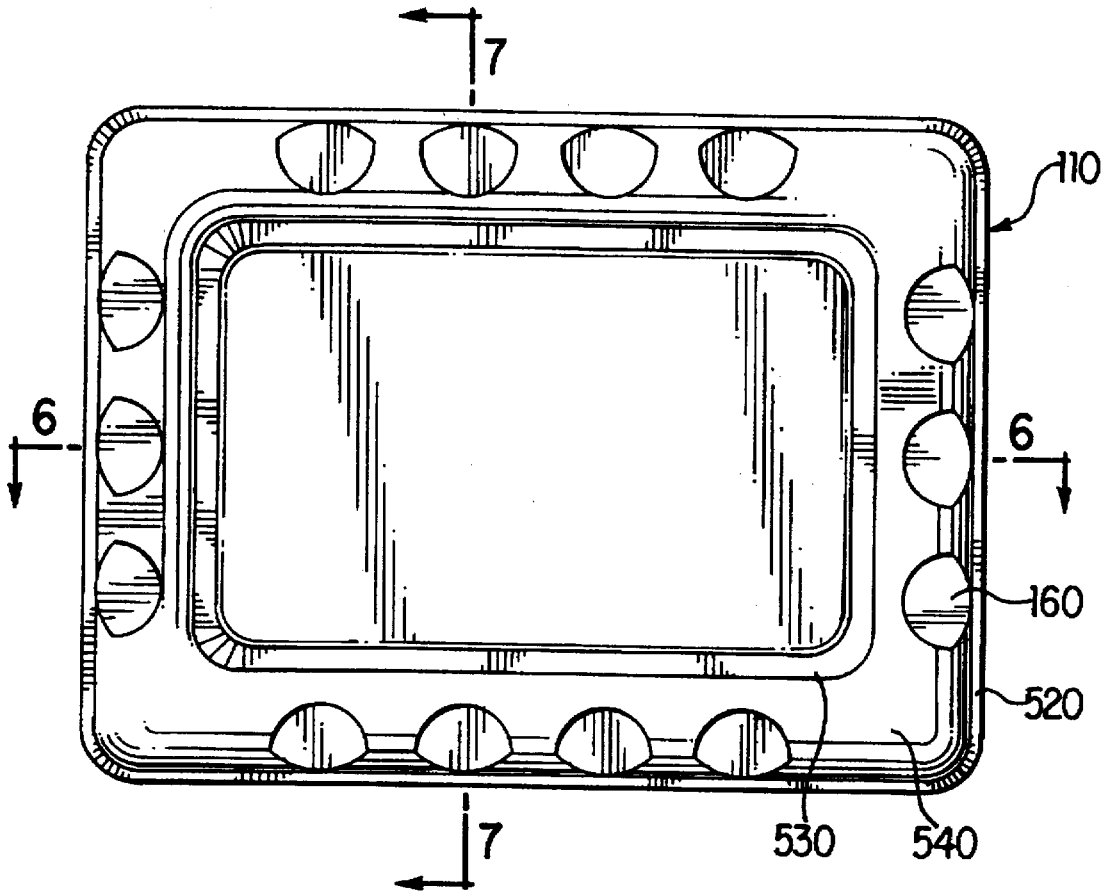
FIG. 5 shows a top view of an outer foam box of the enzyme cooler assembly of FIG. 1.
Figure 6:
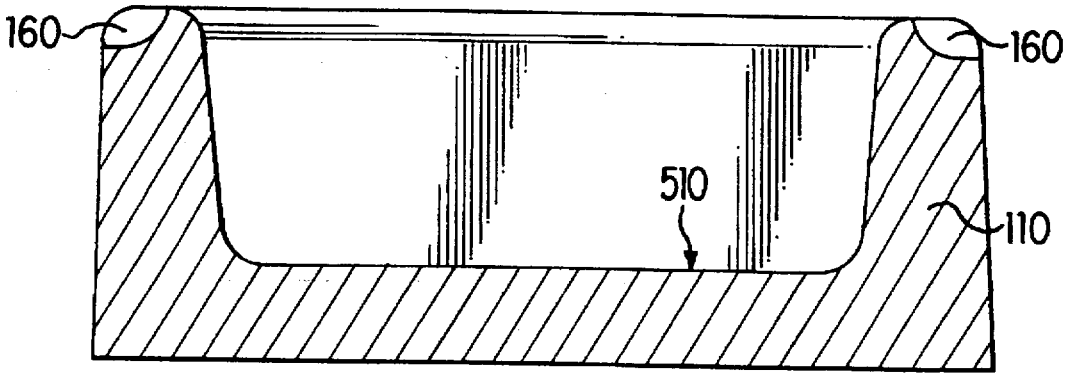
FIG. 6 shows a sectional side view of the outer foam box of FIG. 5 taken along line 6—6.
Figure 7:
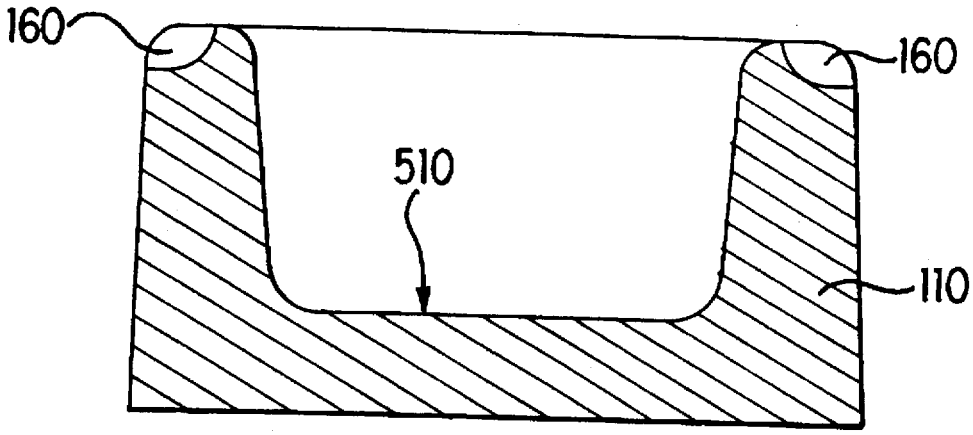
FIG. 7 shows a sectional side view of the outer foam box of FIG. 5 taken along line 7—7.

Referring now to FIGS. 5–7, outer foam box 110 is shown. The cross section of outer foam box 110 is a U-shape, having a hollow portion 510 to house foam block 120. Indentations 160 are formed in area 540 between outer perimeter 520 and inner perimeter 530 of outer foam box 110. Indentations 160 allow the user to insert their fingers between outer foam box 110 and lid 150 to facilitate removal of lid 150.

Figure 8:
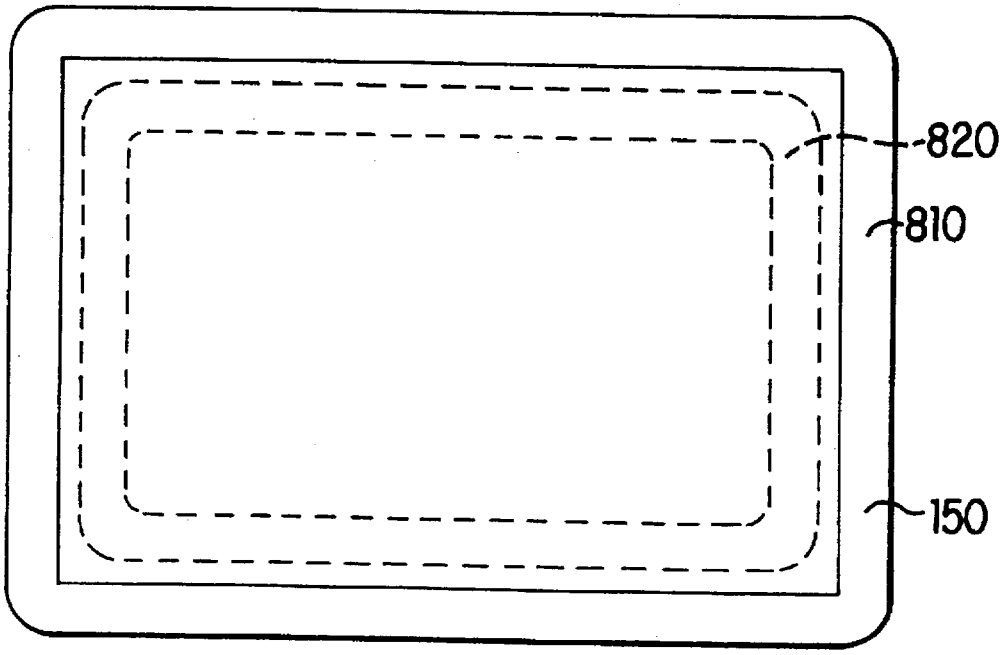
FIG. 8 shows a top view of a lid of the enzyme cooler assembly of FIG. 1.
Figure 9:
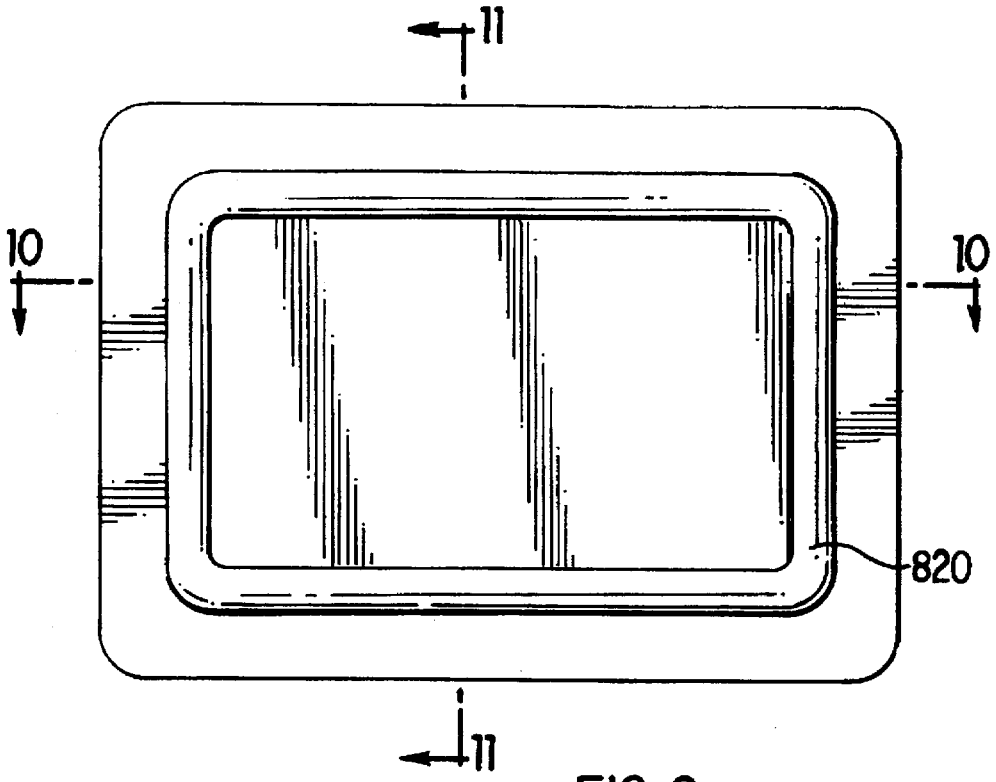
FIG. 9 shows a bottom view of the lid of FIG. 8.
Figure 10:
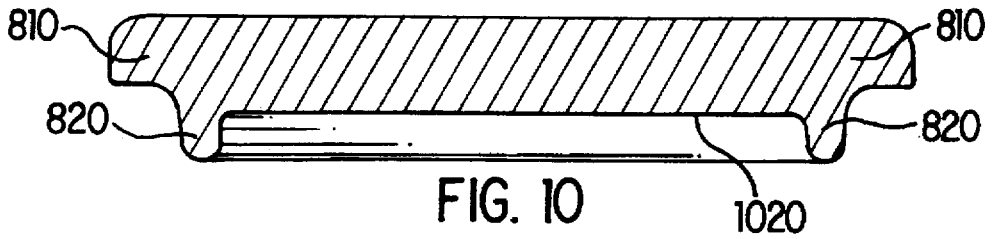
FIG. 10 shows a sectional side view of the lid of FIG. 9 taken along line 10—10.
Figure 11:
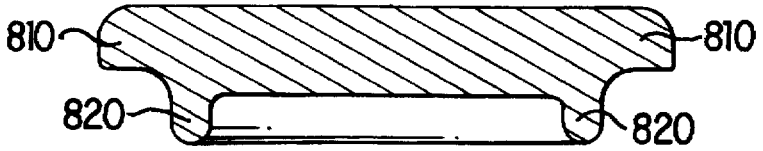
FIG. 11 shows a sectional side view of the lid of FIG. 9 taken along line 12—12.

Referring now to FIGS. 8–11, lid 150 is shown. FIG. 8 shows a top view of lid 150. An outer rim 810 of lid 150 is configured to equal the size of outer perimeter 520 of outer foam box 110. FIG. 9 shows a bottom view of lid 150. An inner rim 820 is disposed on the bottom side 1020 of lid 150. Inner rim 820 is configured so that when lid 150 is placed on top of outer foam box 110, inner rim 820 will fit snugly within the inner perimeter 530 of outer foam box 110 to provide an air tight fit to ensure efficient insulation.

Figure 12:
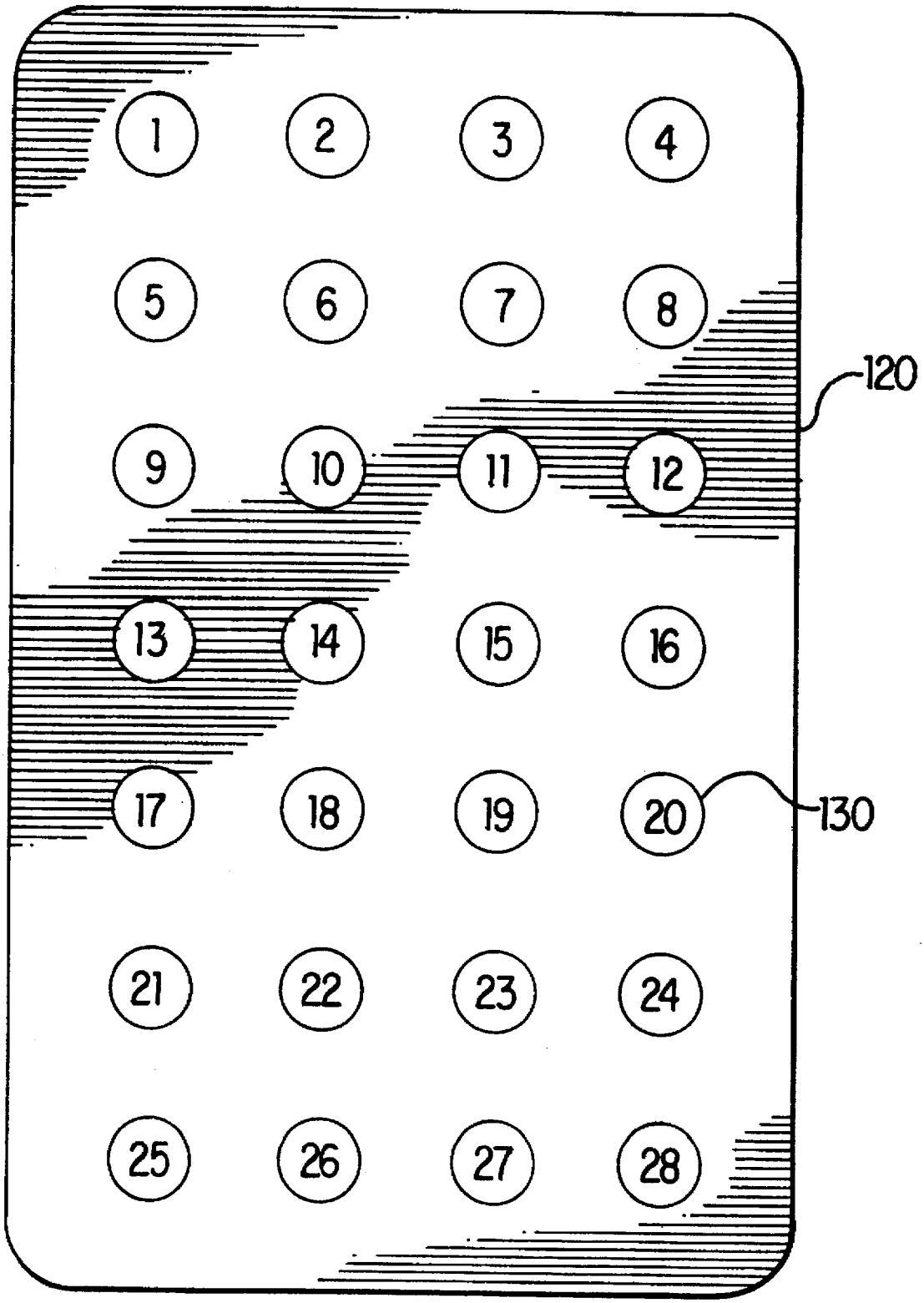
FIG. 12 shows wells of the enzyme cooler assembly of FIG. 1 which have been numbered for ease of subsequent identification and reference.
Figure 13:
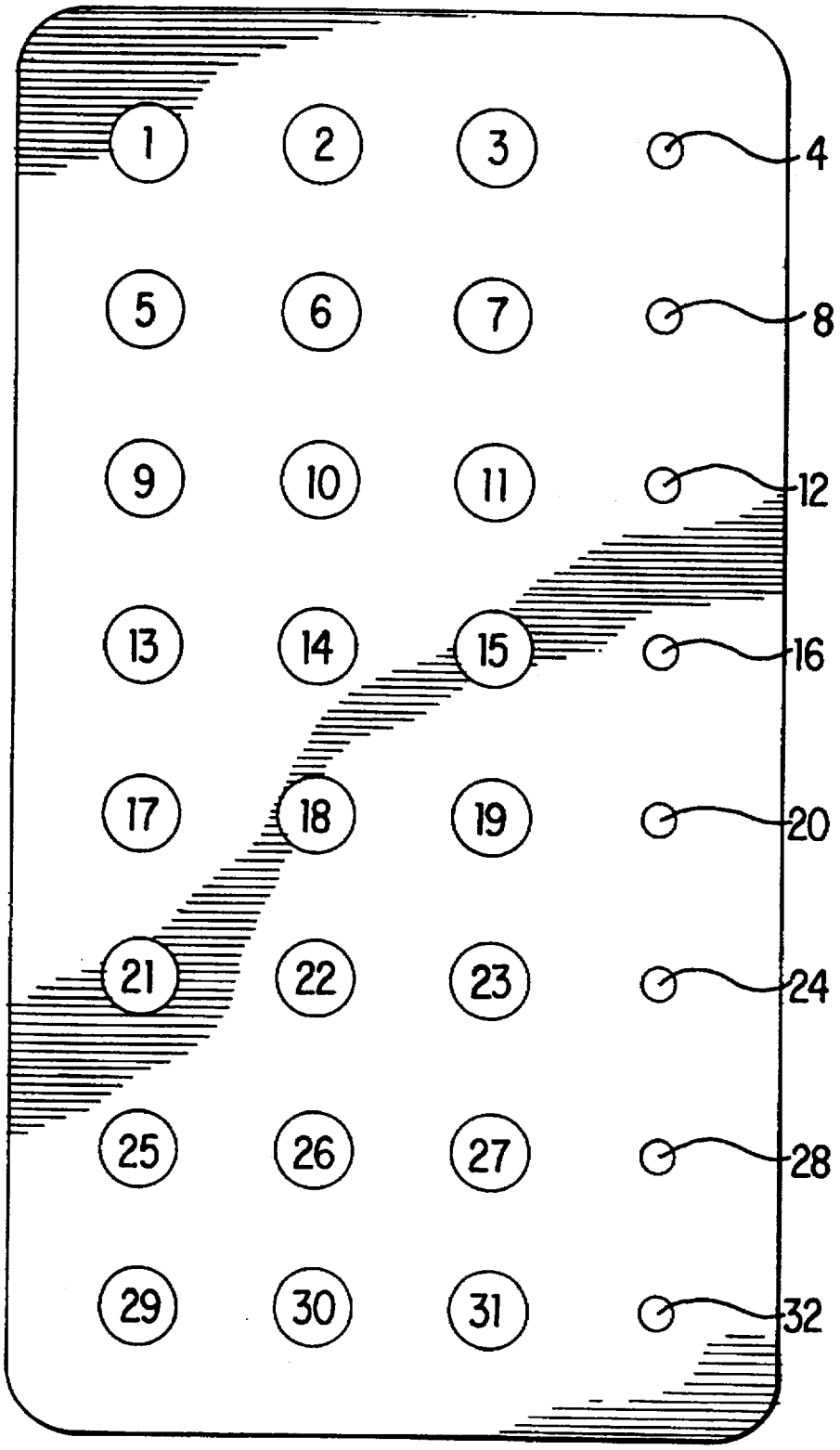
FIG. 13 shows wells of a conventional enzyme cooler which have been numbered for ease of subsequent identification and reference.
Figure 14:
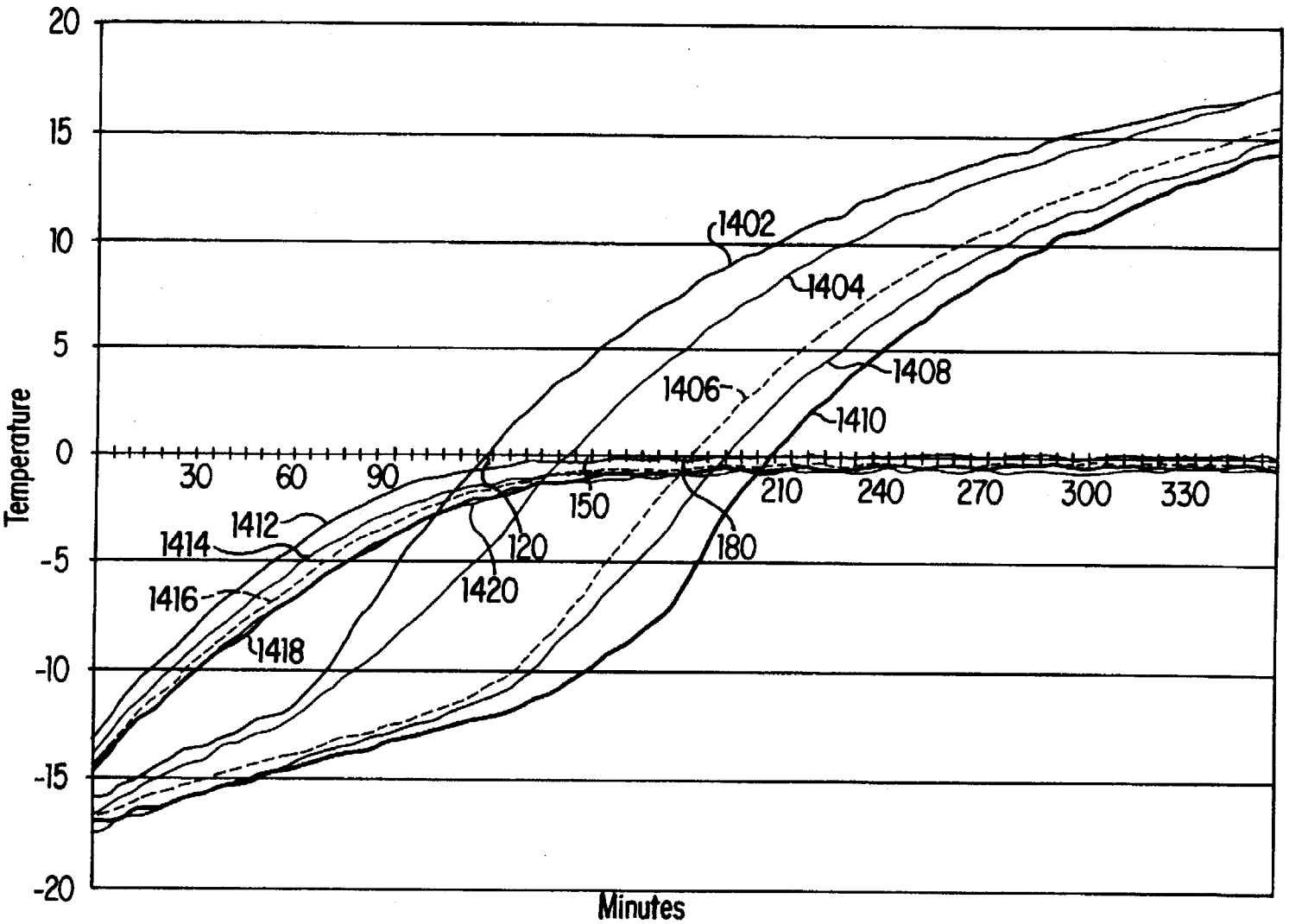
FIG. 14 shows a graph of the temperature change (°C.) over time (minutes) of several wells within the foam block. The foam block is filled with water and is surrounded by the outer foam box and covered by the lid. The graph also shows the temperature change over time of several wells in a conventional enzyme cooler.
Figure 15:
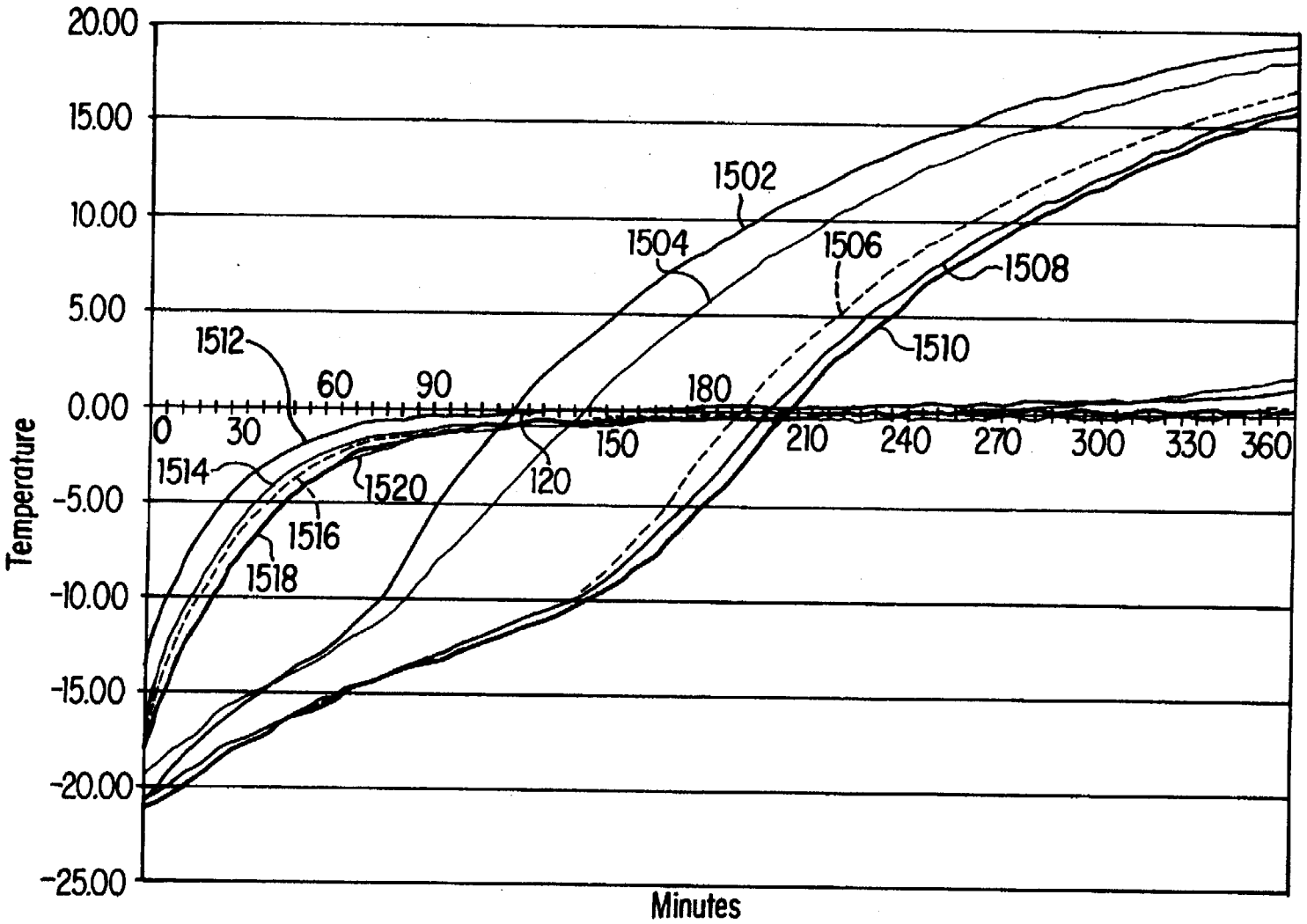
FIG. 15 shows a graph of the temperature change (°C.) over time (minutes) of several wells within the foam block. The foam block is filled with water and is surrounded by the outer foam box. However, the foam block is not covered by the lid. The graph also shows the temperature change over time of several wells in a conventional enzyme cooler.
Figure 16:
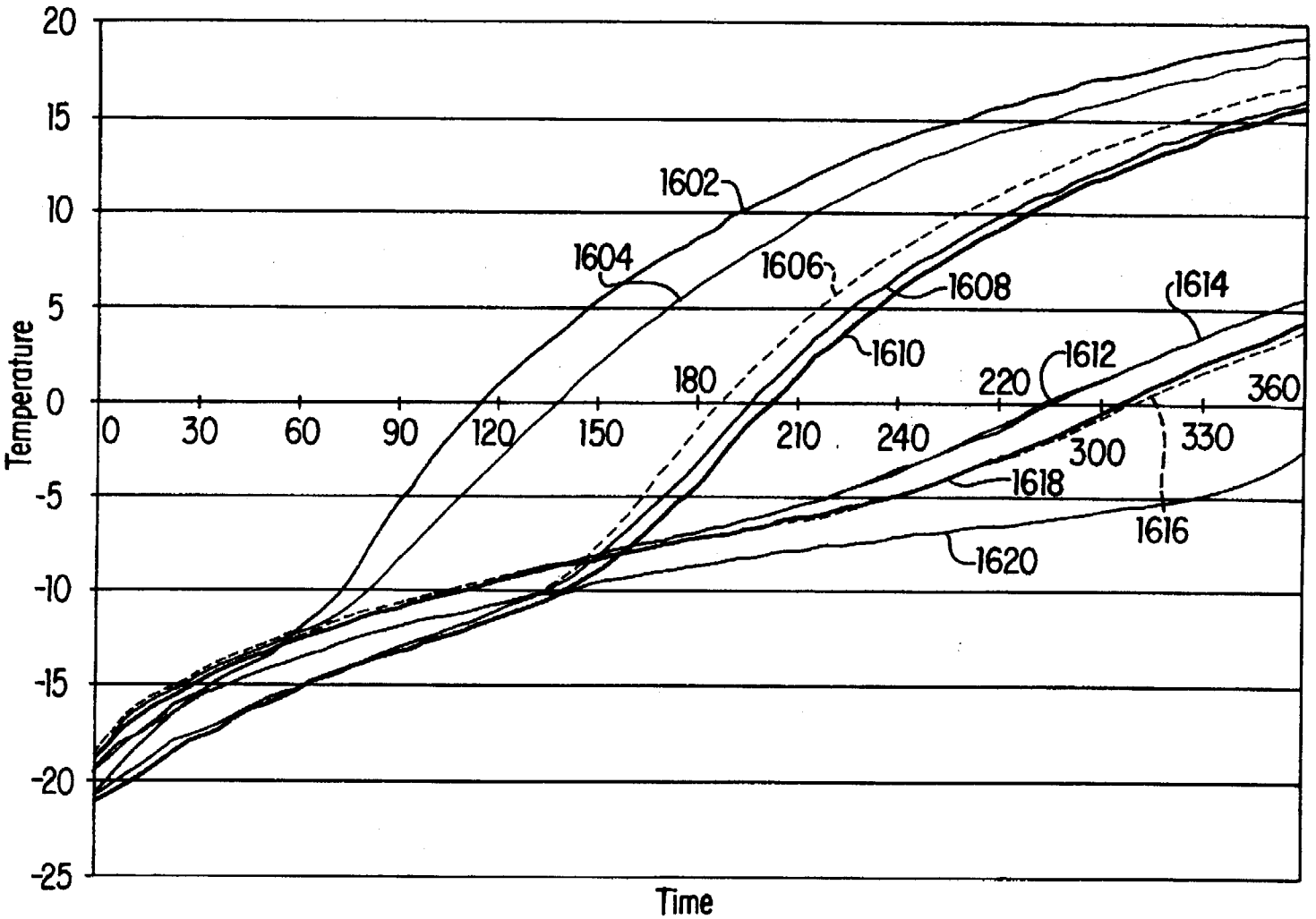
FIG. 16 shows a graph of the temperature change (°C.) over time (minutes) of several wells within the foam block. The foam block is filled with a −6° C. salt solution, and surrounded by the outer foam box. However, the foam block is not covered by the lid. The graph also shows the temperature change over time of several wells in a conventional enzyme cooler.

FIGS. 12 and 13 show the layout of wells 130 of the present invention and the layout of wells in a conventional enzyme cooler, respectively. Each well has been numbered for identification. These numbers will be used below to refer to a particular well. The two configurations shown in FIGS. 12 and 13 were tested to determine the temperature change in particular wells over time. The results of these tests are shown in FIGS. 14–16. The conventional enzyme cooler used in these tests had several wells that were smaller in size than the other wells to accommodate smaller vials. These wells are shown in FIG. 13 as wells numbered 4, 8, 12, 16, 20, 24, 28 and 32.

FIG. 14 shows the results of testing of the present invention and a conventional enzyme cooler. The present invention was filled with water using the method described above. Both coolers were then placed in a −20° C. freezer for approximately 24 hours. The coolers were then removed from the freezer and placed in a testing room at an ambient temperature of approximately 22° C. In this test, the present invention was tested using foam block 120 placed inside outer foam box 110 and having lid 150 on top of outer foam box 110. Lines 1402–1410 show the change in temperature (in degrees Celsius) inside wells 29, 2, 27, 10 and 19, respectively, of the conventional enzyme cooler over time (in minutes). Lines 1412–1420 show the change in temperature (in degrees Celsius) inside wells 25, 2, 23, 15 and 10, respectively, of the present enzyme cooler assembly 100 over time (in minutes). As shown, the temperature in wells 130 of enzyme cooler assembly 100 rose gradually over time while the temperature in the wells of the conventional enzyme cooler rose rapidly into a critical temperature range. In all three tests shown in FIGS. 14–16, the critical temperature at which the enzymes would begin to be rendered inactive was +4° C. However, the critical temperature may vary depending on the type of samples used for testing.

FIG. 15 also shows the performance of the present invention versus a conventional enzyme cooler. The present invention was filled with water using the method described above. Both coolers were placed in a −20° C. freezer for approximately 24 hours. The coolers were then removed from the freezer and placed in a testing room at an ambient temperature of approximately 22° C. In this test foam block 120 of the present invention was placed inside outer foam block 110. However, lid 150 was removed from on top of outer foam box 110. The lid of the conventional enzyme cooler was also removed. Lines 1502–1510 show the change in temperature (in degrees Celsius) inside wells 25, 2, 21, 10 and 15, respectively, of a conventional enzyme cooler over time (in minutes). Lines 1512–1520 show the change in temperature (in degrees Celsius) inside wells 25, 2, 23, 15 and 10, respectively, of the present enzyme cooler assembly 100 over time (in minutes). As shown, even without lid 150, the temperature in wells 130 of enzyme cooler assembly 100 rose gradually over time while the temperature in the wells of the conventional enzyme cooler rose rapidly into a critical temperature range.

FIG. 16 shows the performance of the present invention versus a conventional enzyme cooler. In this test, the present invention was filled with a −6° C. salt solution using the method described above. Both coolers were placed in a −20° C. freezer for approximately 24 hours. The coolers were then removed from the freezer and placed in a testing room at an ambient temperature of approximately 22° C. In this test, foam block 120 of the present invention was placed inside outer foam block 110. However, lid 150 was removed from on top of outer foam box 110. The lid of the conventional enzyme cooler was also removed. Lines 1602–1610 show the change in temperature (in degrees Celsius) inside wells 22, 3, 19, 2 and 5, respectively, of a conventional enzyme cooler over time (in minutes). Lines 1612–1620 show the change in temperature (in degrees Celsius) inside wells 2, 10, 21, 15 and 25, respectively, of the present enzyme cooler assembly 100 over time (in minutes). As shown, even without lid 150, the temperature in wells 130 of enzyme cooler assembly 100 rose gradually over time while the temperature in the wells of the conventional enzyme cooler rose rapidly into a critical temperature range. Further, as the results shown in FIG. 16 demonstrate, variation of the coolant used in foam block 120 will result in a variation of the time it takes the temperature of the wells to reach a critical temperature.

While the invention has been particularly shown and described with reference to preferred embodiments thereof, it will be understood by those skilled in the art that various changes in form and details may be made therein without departing from the spirit and scope of the invention.

What is claimed is:

1. A cooler, comprising:

a foam block having a substantially porous inner portion covered by a substantially leakproof skin, said foam block being configured to contain a coolant within cells of said porous inner portion, said foam block defining a well therein, wherein said well is configured and arranged to receive a workpiece and to provide for the efficient transfer of heat between said coolant and said workpiece.

2. The cooler of claim 1, wherein said foam block forms therein a fill hole, and wherein said fill hole is unsealed such that said coolant is introduced into said foam block via said fill hole and air contained within said foam block escapes via said fill hole, thereby filling said foam block with said coolant.

3. The cooler of claim 2, further comprising a plug to seal said fill hole in said foam block.

4. The cooler of claim 1, further comprising:

an outer foam box surrounding said foam block to provide insulation.

5. The cooler of claim 4, further comprising:

a lid disposed on top of said outer foam box.

6. The cooler of claim 1, wherein said foam block is made of self-skinning open cell foam.

7. The cooler of claim 1, wherein said coolant is water.

8. The cooler of claim 1, wherein said coolant is a brine solution.

9. The cooler of claim 1, wherein said coolant is glycerine.

10. The cooler of claim 1, wherein said coolant is a gel made from starch.

11. A cooler for maintaining a vial filled with a sample in a cooled state, comprising:

a foam block having a substantially porous inner portion covered by a substantially leakproof skin, said foam block being configured to contain a coolant within cells of said porous inner portion, and said foam block defining a well therein, wherein said well is configured and arranged to receive the vial and to provide for the efficient transfer of heat between said coolant and the sample in the vial.

12. The cooler of claim 11, wherein said foam block forms therein a fill hole, and wherein said fill hole is unsealed such that said coolant is introduced into said foam block via said fill hole and air contained within said foam block escapes via said fill hole, thereby filling said foam block with said coolant.

13. The cooler of claim 12, further comprising a plug to seal said fill hole in said foam block.

14. The cooler of claim 11, further comprising:

an outer foam box surrounding said foam block to provide insulation.

15. The cooler of claim 14, further comprising:

a lid disposed on top of said outer foam box.

16. The cooler of claim 11, wherein said foam block is made of self-skinning open cell foam.

17. The cooler of claim 11, wherein said coolant is water.

18. The cooler of claim 11, wherein said coolant is a brine solution.

19. The cooler of claim 10, wherein said coolant is glycerine.

20. The cooler of claim 11, wherein said coolant is a gel made from starch.

21. A cooler assembly, comprising:

a foam block having a substantially porous inner portion covered by a substantially leakproof skin, said foam block being configured to contain a coolant in said inner portion, said foam block defining a well therein, wherein said well is configured and arranged to receive a workpiece and to provide for the efficient transfer of heat between said coolant and said workpiece, and wherein said foam block forms therein a fill hole, said fill hole being unsealed such that said coolant is introduced into said foam block via said fill hole and air contained within said foam block escapes via said fill hole, thereby filling said foam block with said coolant;

an outer foam box surrounding said foam block to provide insulation; and a lid disposed on top of said outer foam box.

22. The cooler assembly of claim 21, further comprising a plug to seal said fill hole in said foam block.

23. The cooler assembly of claim 21, wherein said foam block is made from self-skinning, open cell foam.

24. The cooler assembly of claim 21, wherein said coolant is water.

25. The cooler assembly of claim 21, wherein said coolant is a brine solution.

26. The cooler assembly of claim 21, wherein said coolant is glycerine.

27. The cooler assembly of claim 21, wherein said coolant is a gel made from starch.

* * * * *